United States Patent [19]

Coulthard

[11] 4,001,987

[45] Jan. 11, 1977

[54] SCREEN CONSTRUCTIONS

[75] Inventor: James Albert Coulthard, Sheffield, England

[73] Assignee: Kepac, Limited, Sheffield, England

[22] Filed: Feb. 3, 1975

[21] Appl. No.: 546,452

[30] Foreign Application Priority Data

Feb. 8, 1974 United Kingdom ..... 5980/74

[52] U.S. Cl. ..... 52/79.9; 52/239; 40/125 R; 160/135; 248/231

[51] Int. Cl.[2] ..... E04H 1/12

[58] Field of Search ..... 52/79, 71, 64, 65, 238, 52/239, 243, 485, 489; 160/135, 151; 35/60; 40/125 R, 152.1; 211/169, 86, 107, 177, 182; 248/221 R, 221 A–221 F, 226 E, 230, 231

[56] References Cited

UNITED STATES PATENTS

| | | | |
|---|---|---|---|
| 2,245,351 | 6/1941 | Mittleman | 52/243 X |
| 3,111,723 | 11/1963 | Bates | 52/243 X |
| 3,204,689 | 9/1965 | Howell | 160/135 |
| 3,232,370 | 2/1966 | Jaffe | 160/135 X |
| 3,686,810 | 8/1972 | Allen | 52/243 |
| 3,868,081 | 2/1975 | Morgan et al. | 248/231 |
| 3,875,711 | 4/1975 | Palmer | 160/135 X |

*Primary Examiner*—J. Karl Bell
*Attorney, Agent, or Firm*—Lowe, King, Price & Markva

[57] ABSTRACT

A screen construction applicable to exhibition and display purposes but also applicable to booths for attendants or projection equipment, room dividers or toy building kits comprises a plurality of support members of elongate form and uniform circular cross-section, a plurality of rectangular panels, and a plurality of clips secured at least two on each of two opposite edges of each panel and snapping on to the support members, thus enabling adjacent columns of panels to be set at any inclination to each other, the clips on one edge of any panel preferably having spacings from one end of that edge differing from their spacings from the other end of that same edge by at least the thickness of the clips measured in the direction of that edge, whereby two adjacent panels can be attached to one support member with the corresponding edges of the panels perpendicular to the support member in register with each other thus enabling a solid screen to be constructed.

20 Claims, 6 Drawing Figures

SCREEN CONSTRUCTIONS

This invention relates to screen constructions, more particularly for exhibition and display purposes, but also applicable inter alia to booths for attendants or projection equipment, room dividers, and toy building kits, and has for its object the provision of a screen construction that is made up of readily transportable parts capable of rapid assembly and dismantling and also adaptable to a wide variety of exhibition and display forms, and to other purposes.

According to the present invention, a screen construction comprises a plurality of support members of elongate form and uniform circular cross-section, a plurality of rectangular panels, and a plurality of clips secured at least two on each of two opposite edges of each panel and snapping on to the support members.

While the use of panels of different dimensions is within the scope of the invention, the invention is preferably based on panels all having the same or modular dimensions and preferably mainly square, as this combination proves most convenient for the packing and transporting of the panels and avoids any need to sort the panels into sizes before assembling a screen, but sorting of square panels with a standard dimension may be necessary with regard to matter displayed on the panels or with regard to the purpose to which they are put, e.g. doors and windows.

The clips on one edge of any panel preferably have spacings from one end of that edge differing from their spacings from the other end of that same edge by at least the thickness of the clips measured in the direction of that edge, whereby two adjacent panels can be attached to one support member with the corresponding edges of the panels perpendicular to the support member in register with each other. Conveniently, the clips on one edge of any panel have spacings from one end of that edge that same as the spacings of the clips on the opposite edge of the panel from the opposite end of that opposite edge. However, some panels may have spacings of their clips differing by at least twice and others by at least three times the thickness of the clips, whereby three or four adjacent panels can be attached to one support member with the corresponding edges of the panels perpendicular to the support member in the same plane as each other.

The support members conveniently consist of lengths of tube (e.g., plastics tube as is used for domestic water supply, aluminium tube, or-preferably- steel tube with a reflective finish, and the clips which are conveniently of plastics material, preferably likewise have a reflective finish. Bases may be provided for the support members, but an assembly consisting of three or more support members standing on end will be perfectly stable if adjacent columns of panels are inclined to each other. Connectors, such as branch pipe fittings, elbows, and tube clamps, may be provided for joining support members together, end-to-end and/or perpendicular to each other, to increase the size and/or variety of display or shape of an assembly. Endcaps may be provided for closing the cut ends of tubular support members, and end caps for use as feet may be the same as end caps for use at upper ends of upright support member.

For display purposes the panels may comprise frame members rigidly secured together at their respective adjacent ends, and tensioned plastics film applied over at least one face (but preferably both faces) of the frame and secured there to paper display material applied over or under the plastics film on a frame receives adequate support or protection from the plastics film regardless of the manner in which the paper display material is secured to the frame, but the paper display material is preferably applied in a damp condition and secured to the frame by edge portions, so that as the paper dries (whether naturally or induced) it shrinks and becomes tensioned over or under the tensioned plastics film and, therefore, presents a very smooth appearance. The plastics film may be translucent, to enable it to serve as a back projection screen or for the display material to be illuminated by natural or artificial light from one face of the frame, and/or the plastics film may be coloured, to enable the display material to be tinted, or the plastics film may be coated with reflective material so as to form a mirror The frame members may be made of plastics or metal, but are preferably made of wood, as this enables plastics film and/or paper display material to be secured quickly by means of staples into the frame members, or to plastics, metal, or wooden frames by providing grooves in the edges of the frame members into which the film and/or paper is secured by wires pressed into the grooves. The frame members may be secured together with staples or by adhesive at mitred corners or butt joints, or they may be provided with inserts at or near their ends to receive fixing screws passing through holes in respective adjacent ends.

The clips, which may be bolted or (preferably) screwed to the frame members, may be provided with pads of friction material, e.g. rubber, for making contact with the support members and thereby assisting in holding the panels in position.

For room dividers or toy building kits the panels may comprise mouldings complete with clips.

A shelf or sill member may be provided with brackets to fit in a space between panels, to provide a counter or display opening, or to simulate a window as the case may be.

Embodiments of the invention will now be described, by way of example only, with reference to the accompanying drawings, in which FIG. 1 is a perspective view of a screen construction in accordance with the invention arranged as a display incorporating a counter or display opening;

Figure 1:
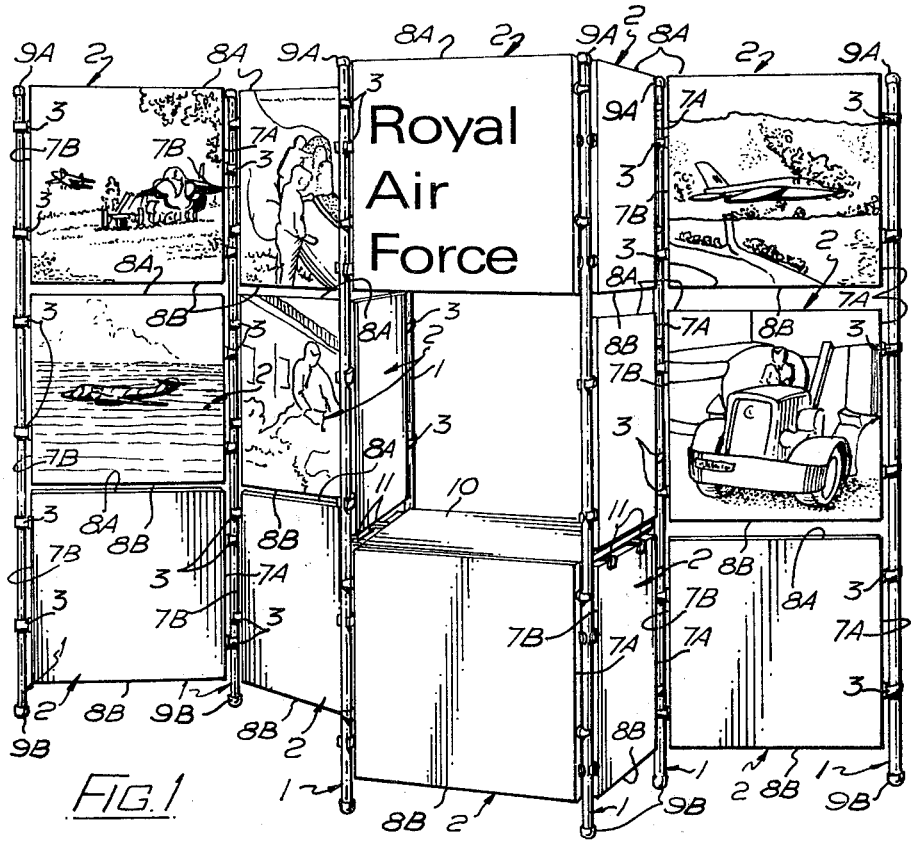
Figure 3:
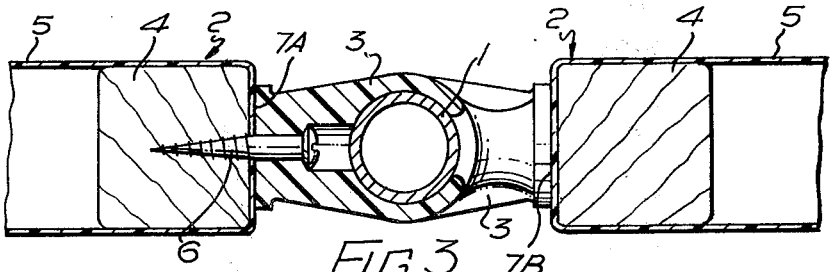
FIG. 3 is a fragmentary section from the line III—III of FIG. 2.
Figure 2:
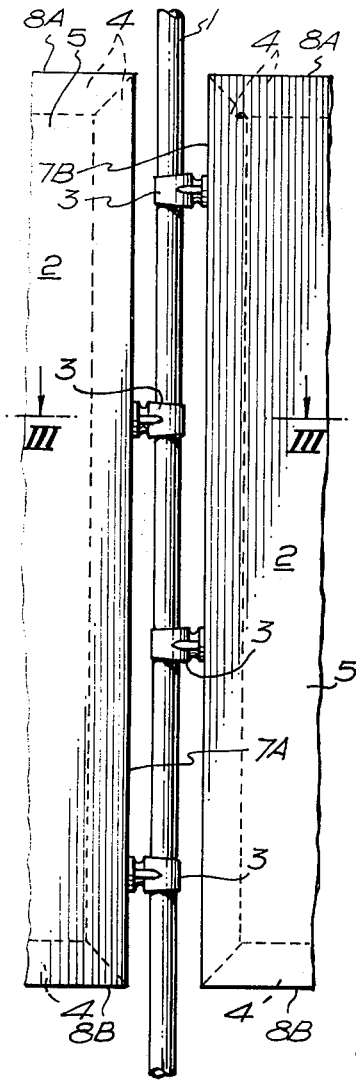
FIG. 2 is an enlarged fragmentary elevation of two adjacent panels of FIG. 1.

The screen construction of the display of FIG. 1 comprises a plurality of upright support members 1 of elongate form and uniform circular cross-section, a plurality of square panels 2, and a plurality of clips 3 secured two on each of two opposite edges of each panel and snapping on to the support members (see also FIG. 2). It will be seen from FIG. 3 that the support members 1 consist of lengths of tube, preferably steel tube with a reflective finish, e.g. chromium-plated, that the clips 3 are of plastics material, preferably likewise having a reflective finish, and that the panels 2 comprise a wooden frame member 4 (see also FIG. 2) rigidly secured together at their respective adjacent ends and covered with tensioned plastics film 5 applied over both faces of the frame, the clips 3 being secured to the panels by wood screws 6. It will be seen from FIGS. 1 and 2 that the clips 3 on one edge 7A of any panel 2 have spacings from one end of that edge differing from their spacings from the other end of that same edge by more than the thickness of the clips measured in the direction of that edge, and the clips on the opposite edge 7B have the same spacing from the opposite end of that opposite edge, whereby all across the display two adjacent panels can be attached to one support member with the corresponding edges 8A or 8B of the panels perpendicular to the support member in register with each other.

The tubular support members 1 are provided with end caps 9A, 9B (FIG. 1) for closing their cut ends, and the end caps 9B serving as feet are the same as the end caps 9A at the upper ends.

A shelf 10 (FIG. 1) provided with brackets 11 is fitted in a space (formed by omitting a panel in the middle of a projecting portion of the display) to provide a counter or display opening between panels carrying paper display material, e.g. photographic prints, secured by staples or adhesive.

Figure 4:
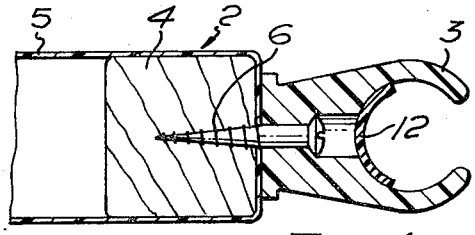
FIG. 4 is a fragmentary section corresponding to part of FIG. 3 but showing a modification.

In FIG. 4 a clip 3 is shown provided with a pad 12 of friction material, e.g. rubber, for making contact with a support member 1 (not shown) and thereby assist in holding the panel 2 in position.

Figure 5:
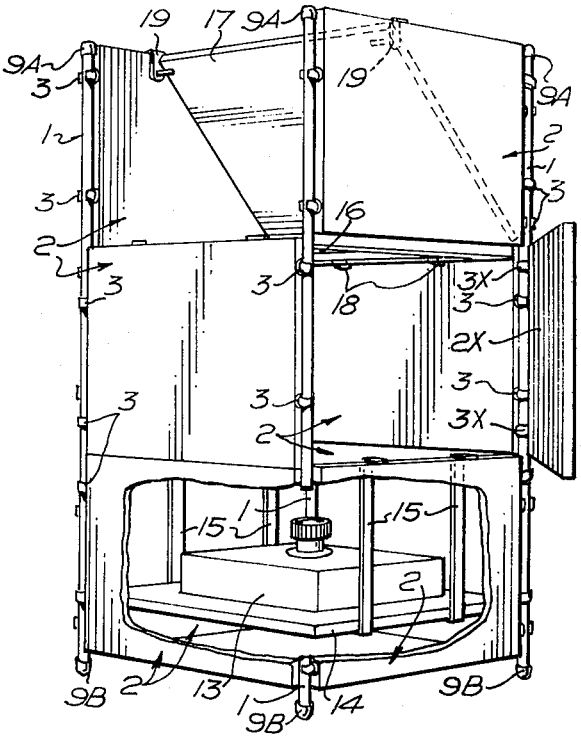
FIGS. 5 and 6 are perspective views, with portions broken away, of screen constructions in accordance with the invention arranged as booths incorporating projection equipment.
Figure 6:
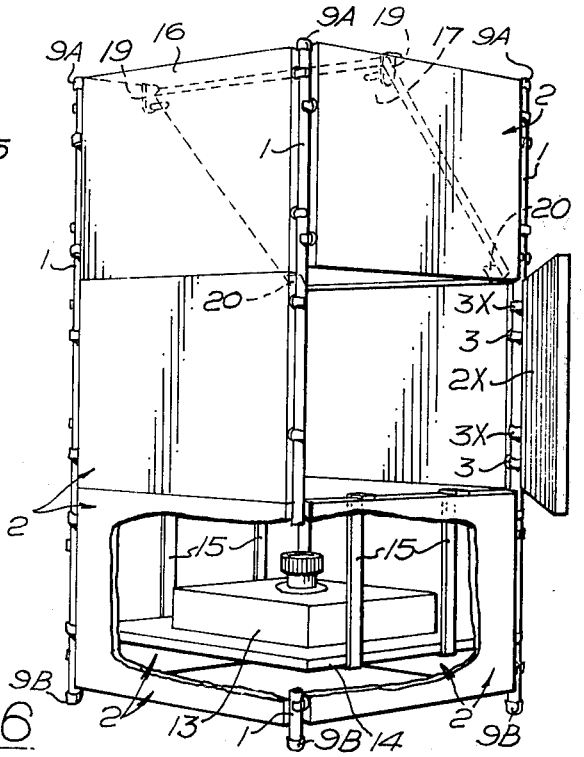

In FIGS. 5 and 6 booths for projection equipment each comprise four upright support members 1, 10 panels 2 with clips 3 as in FIG. 1, a panel 2X with clips 3X on one edge only forming a door giving access to a projector 13 on a shelf 14 suspended by brackets 15, a back projection screen 16 and a mirror 17. In FIG. 5 the screen 16 is mounted horizontally on brackets 18 and the picture projected upwardly on to the screen by the projector 13 is viewed in the mirror 17, which has its lower edge resting on the screen and its upper edge supported by brackets 19, while in FIG. 6 the screen 16 has clips 3 similar to the panels 2 for mounting of the screen vertically in front of the mirror 17, which has its lower edge supported by brackets 20 and its upper edge supported by brackets 19, and the picture projected upwardly by the projector 13 is reflected by the mirror 17 on the screen 16.

What I claim is:

1. A screen construction comprising a plurality of support members of elongate form and uniform circular cross-section in contact with the floor, a plurality of rectangular panels, and a plurality of clips secured at least two on each of two opposite edges of each panel, said clips snapping around the support members, each of said clips being open-ended and extending around greater than 180° of the circumference of said circular cross-section support member, adjacent ones of said panels thereby being orientatable at any angle relative to each other, and said support members being free-standing without any overhead support.

2. A screen construction as in claim 1, wherein the panels all have modular dimensions.

3. A screen construction as in claim 2, wherein the panels are mainly square.

4. A screen construction as in claim 2, wherein the clips on one edge of any panel have spacings from one end of that edge differing from their spacings from the other end of that same edge by at least the thickness of the clips measured in the direction of that edge, whereby two adjacent panels can be attached to one support member with the corresponding edges of the panels perpendicular to the support member in register with each other.

5. A screen construction as in claim 4, wherein the clips on one edge of any panel have spacings from one end of that edge the same as the spacings of the clips on the opposite edge of the panel from the opposite end of that opposite edge.

6. A screen construction as in claim 1, wherein the support members consist of lengths of tube.

7. A screen construction as in claim 6, wherein the tube is steel tube with a reflective finish.

8. A screen construction as in claim 1, wherein the clips are of plastics material.

9. A screen construction as in claim 8, wherein the clips have a reflective finish.

10. A screen construction as in claim 6, wherein end caps are provided for closing the cut ends of the tubular support members.

11. A screen construction as in claim 1, wherein the panels comprise frame members rigidly secured together at their respective adjacent ends, and tensioned plastics film applied over at least one face of the frame and secured thereto.

12. A screen construction as in claim 11, wherein paper display material is applied over the plastics film on a frame.

13. A screen construction as in claim 11, wherein paper display material is applied under the plastics film on a frame.

14. A screen construction as in claim 11, wherein the plastics film is translucent.

15. A screen construction as in claim 11, wherein the plastics film is coated with reflective material so as to form a mirror.

16. A screen construction as in claim 11, wherein the frame members are made of wood.

17. A screen construction as in claim 16, wherein paper display material is secured by staples into the frame members.

18. A screen construction as in claim 11, wherein the clips are screwed to the frame members.

19. A screen construction as in claim 1, wherein the clips are provided with pads of friction material for making contact with the support members and thereby assisting in holding the panels in position.

20. A screen construction as in claim 1, wherein a shelf member is provided with brackets to fit in a space between panels.

* * * * *